US008479779B2

(12) United States Patent
Behar

(10) Patent No.: US 8,479,779 B2
(45) Date of Patent: Jul. 9, 2013

(54) METHOD AND A DEVICE FOR FILLING A RESERVOIR OF VARIABLE WORKING VOLUME

(75) Inventor: Alain Behar, Suresnes (FR)

(73) Assignee: Aptar France SAS, Le Neubourg (FR)

( * ) Notice: Subject to any disclaimer, the term of this patent is extended or adjusted under 35 U.S.C. 154(b) by 0 days.

(21) Appl. No.: 13/267,188

(22) Filed: Oct. 6, 2011

(65) Prior Publication Data

US 2012/0024419 A1 Feb. 2, 2012

Related U.S. Application Data

(62) Division of application No. 11/910,829, filed as application No. PCT/FR2006/050318 on Apr. 10, 2006, now Pat. No. 8,061,393.

(30) Foreign Application Priority Data

Apr. 12, 2005 (FR) ..... 05 50926

(51) Int. Cl.

| | |
|---|---|
| ***B65B 1/04*** | (2006.01) |
| ***B65B 7/00*** | (2006.01) |
| ***B65B 31/00*** | (2006.01) |
| *B65B 7/28* | (2006.01) |

(52) U.S. Cl.

CPC ..... *B65B 31/003* (2013.01); *B65B 7/2878* (2013.01)

USPC ..... 141/3; 141/7; 141/20; 141/61; 141/285; 53/470; 53/471

(58) Field of Classification Search

USPC ..... 141/3, 7, 8, 10, 20, 59, 61, 114, 285, 141/301; 53/470, 471; 137/205

See application file for complete search history.

(56) References Cited

U.S. PATENT DOCUMENTS

| | | | | |
|---|---|---|---|---|
| 3,995,666 | A | 12/1976 | Michaels | |
| 4,150,522 | A * | 4/1979 | Burger | 53/470 |
| 4,481,753 | A * | 11/1984 | Rutter et al. | 53/471 |
| 4,501,306 | A * | 2/1985 | Chu et al. | 141/94 |
| 4,896,794 | A * | 1/1990 | Banks et al. | 222/1 |
| 4,984,712 | A | 1/1991 | Jouillat | |
| 5,505,039 | A | 4/1996 | Maier | |
| RE35,683 | E | 12/1997 | Varlet | |
| 5,975,163 | A | 11/1999 | Gianfranco | |
| 6,196,275 | B1 | 3/2001 | Yazawa et al. | |
| 6,874,544 | B2 * | 4/2005 | O'Connor et al. | 141/3 |
| 8,016,003 | B2 * | 9/2011 | Bullen | 141/59 |
| 8,061,393 | B2 * | 11/2011 | Behar | 141/20 |

* cited by examiner

*Primary Examiner* — Timothy L Maust
(74) *Attorney, Agent, or Firm* — Sughrue Mion, PLLC

(57) ABSTRACT

A filling method for filling a reservoir (10) of variable working volume with a fluid, the method being characterized in that the reservoir (10) is firstly emptied of any content, such that its working volume is substantially zero, and the fluid is then injected into the reservoir, thereby increasing the working volume of the reservoir (10).

3 Claims, 3 Drawing Sheets

METHOD AND A DEVICE FOR FILLING A RESERVOIR OF VARIABLE WORKING VOLUME

Figure 1:
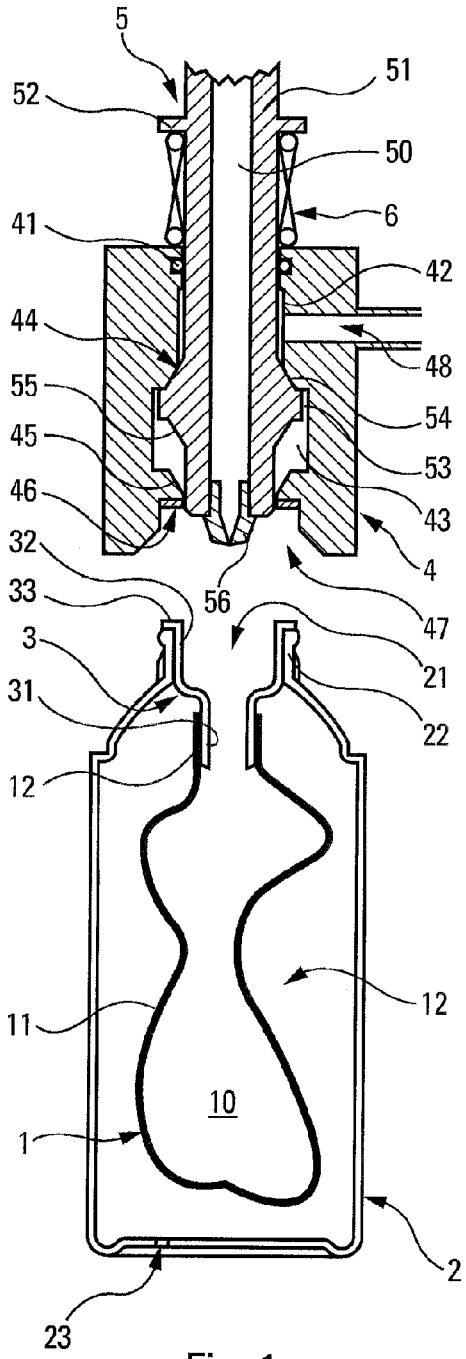

This is a Divisional of Application No. 11/910,829, filed Oct. 5, 2007, which is a 371of PCT/FR2006/050318, filed, Apr. 10, 2006, claiming priority based on French Patent Application No. 05/50926 filed Apr. 12, 2005, the contents of all of which are incorporated herein by reference in their entirety.

The present invention relates to a method and to a device for filling a reservoir of variable working volume with a fluid. The term "fluid" is used to cover liquids that are viscous to a greater or lesser extent, powders, and gases. It is also possible to envisage a mixture of liquids, powders, and/or gases. The present invention applies in very general manner to the field of fluid packaging, and more particularly to the fields of perfumery, cosmetics, or even pharmacy.

It is already known to package various fluids in reservoirs of variable working volume, such as flexible pouches, deformable tubes, deformable bottles, or even in follower-piston systems in which a follower piston (or scraper) is displaced inside a cylinder. In all of these configurations, the working volume of the reservoir decreases as the fluid is extracted therefrom. In order to extract the fluid, it is also conventional to use a dispenser member, such as a pump or a valve. Either way, actuating the pump or the valve causes a certain optionally-metered quantity of fluid to be dispensed from the reservoir, thereby causing its working volume to decrease.

In some fields, such as the cosmetics field, for example, it is advantageous, even indispensable, to package the fluid inside the reservoir without said fluid remaining in contact with air. In other words, the packaging is packed under a vacuum, or at least with a very small volume of air remaining inside the reservoir. A conventional technique for filling a flexible pouch consists in inflating the pouch with compressed air such that it offers a maximum capacity, indeed a capacity that is greater than the volume to be inserted. A certain desired quantity of fluid is then injected therein, the pump is pre-positioned on the reservoir, then both the packaging and the pump are placed in a vacuum chamber so as to evacuate the air present in, and at the surface of, the fluid already contained in the reservoir. A final step consists in fastening the pump on the reservoir in leaktight manner. It is then possible to interrupt the vacuum. A variant method of filling consists in performing all of the filling operations under a vacuum. Either way, in order to obtain good quality packaging, i.e. packaging with no air, or practically no air, it has up until now been necessary to use a vacuum chamber, thus requiring complicated and costly apparatus to be used.

An object of the present invention is to remedy the above-mentioned drawbacks of the prior art by defining a filling method that is particularly simple to implement, with equipment that is relatively simple.

To achieve these objects, the present invention proposes a filling method for filling a reservoir of variable working volume with a fluid, the method being characterized in that the reservoir is firstly emptied of any content, such that its working volume is substantially zero, and is preferably zero, and the fluid is then injected into the reservoir, thereby increasing the working volume of the reservoir.

Advantageously, the fluid is injected into the reservoir while the working volume of the reservoir is being maintained substantially or completely at zero. The evacuation step and the subsequent injection step are preferably performed while an opening of the reservoir is being maintained leaktight. Advantageously, the step of filling with fluid is followed by a step of mounting a dispenser member, such as a pump or a valve, on the reservoir in leaktight manner.

Rather than place the reservoir in a vacuum chamber, or remove the air once the reservoir has been filled, the present invention envisages injecting the fluid into a reservoir while its working volume is as close to zero as possible. In this way, it is possible to avoid air being held captive inside the reservoir while the fluid is being injected. This makes it possible to guarantee that the reservoir is filled with fluid only, to the exclusion of any air. To do this, a reservoir is used that has a working volume that starts at zero. It is advantageous to maintain the volume of the reservoir substantially at zero until the fluid is injected. To do this, it is not necessary to leave the vacuum pump running: it suffices to isolate the reservoir from the outside. Once the reservoir has been filled, the reservoir can be returned to atmospheric pressure and the pump or the valve can be mounted in leaktight manner on the reservoir by means of any appropriate fastening technique. It is not really necessary or indispensable for the reservoir to be situated in a vacuum chamber while the pump or the valve is being mounted, given that the filling method of the present invention guarantees that the reservoir is filled entirely and solely with fluid, to the exclusion of any air.

The present invention also defines a filling device for filling a reservoir of variable working volume with a fluid, the device being characterized in that it includes sealing means for isolating the inside of the reservoir from the outside, and evacuation means for evacuating the content of the reservoir. Advantageously, the filling device further includes injection means for injecting fluid into the reservoir. In a practical embodiment, the device includes an evacuating/filling head that is suitable for being fitted in leaktight manner on the reservoir, the head being connectable to a vacuum source and to a fluid-injection source. Advantageously, the head comprises: a sleeve that is provided with sealing means for sealing an opening of the reservoir, and with a vacuum connector for connecting to the vacuum source; and a fluid-injection plunger that is slidably displaceable in the sleeve. The plunger is preferably displaceable between two leaktight abutment positions in which the vacuum connector does not communicate with the sealing means, the connector communicating with the sealing means while the plunger is between the abutment positions. In practical manner, an evacuation path is defined between the sleeve and the plunger, the path connecting the vacuum connector to the sealing means, the plunger being resiliently urged by return means into the high abutment position, and being displaceable against the return means towards the low abutment position, the plunger being in the high position before evacuation, and in the low position after evacuation and while fluid is being injected.

The filling device of the invention enables the injection step to follow the evacuation step without interruption. The displacement of the injection plunger inside the sleeve makes it possible to activate and to deactivate evacuation of the reservoir. While the injection plunger is in abutment inside the sleeve, the evacuation step is interrupted. Between the two abutments, evacuation is possible. The return means urge the injection plunger into its high abutment position that corresponds to a rest position in which evacuation is not possible. While the plunger is in its low abutment position in the sleeve, evacuation is also not possible, given that this corresponds to the injection step for injecting fluid into the reservoir. And while the plunger is in neither its high nor its low abutment positions, an evacuation path is established between the vacuum connector and the inside of the reservoir, such that evacuation is thus possible. The evacuating/filling head of the invention is a relatively simple mechanical system that uses only two parts that are movable relative to each other under the action of a spring. The evacuating/filling head can be mounted in the place of a conventional filling head that performs only a conventional fluid-injection step.

According to another advantageous characteristic of the invention, the plunger includes an outlet orifice that is provided with a shutter that prevents fluid contained in the plunger from being sucked out while the evacuation means are in operation. It is necessary to prevent fluid from being sucked through the sleeve and up to the vacuum pump, since that could damage it.

The invention is described below with reference to the accompanying drawings that show an embodiment of the invention by way of non-limiting example.

In the figures:

FIGS. 1 to 6 show a filling device of the invention during one complete operating cycle of evacuating and filling a fluid reservoir of variable capacity.

In the various figures, the filling device constituting the non-limiting embodiment of the invention is shown associated with packaging or a receptacle of variable working volume of a particular, but well-known, type. The packaging or receptacle includes a reservoir 1 of variable working volume that, in this embodiment, is in the form of a flexible pouch that can be made from a film laminate made of plastics material and aluminum, for example. The flexible pouch 11 defines an opening that is fastened in leaktight manner, advantageously by heat-sealing, onto a pouch support 3. The pouch support comprises a fastener sleeve 31 that is engaged inside the opening 12, and an anchor bushing 32 that is terminated by a collar 33 that projects radially outwards. In addition, the packaging or receptacle includes a rigid outer shell 2 that can be made out of any rigid or substantially-rigid material. However, in some circumstances, it is possible to envisage making the outer shell 2 out of a flexible material, so as to impart a certain degree of resilience thereto. The outer shell 2 includes a bottom wall that is provided with a vent hole 23. At is opposite end, the shell 2 includes a neck 22 that defines an opening 21. The pouch 11 is disposed inside the shell 2 with the pouch support 3 engaged with the neck 22. More precisely, the bushing 32 is housed inside the neck 22 with the collar 33 that bears against the top end edge of the neck 22. This is a fairly conventional design for packaging that integrates a reservoir of variable working volume in the form of a freely-deformable flexible pouch. The vent hole 23 puts the space 12 between the shell 2 and the flexible pouch 11 into communication with the outside, such that said space 12 is always at atmospheric pressure.

Instead of the flexible pouch fastened on a support, it is also possible to use a deformable bottle, a resilient pouch, a follower-piston system, or, more generally, any reservoir of variable working volume.

The filling device of the invention is shown only in part in FIGS. 1 to 6: the filling device of the invention also includes other elements or members that are not shown, since their characteristics are not critical to the present invention. The only portion of the filling device that is shown in the figures is constituted by an evacuating/filling head that comes directly into engagement with the above-described packaging or receptacle. The evacuating/filling head should also be provided with support and displacement means (not shown) for supporting and displacing the head. The head should also be connected to a vacuum source (not shown) and to a fluid source (not shown).

The evacuating/filling head shown in FIGS. 1 to 6 includes an outer sleeve 4 and an internal injection plunger 5. Return means 6, in the form of a return spring, urge the plunger 5 relative to the sleeve towards a rest position, as described below.

The sleeve 4 presents a shape that is very generally cylindrical, thereby defining a hollow inside that can be divided overall into three portions, namely a top duct 42, an intermediate chamber 43, and a sealing and injection mouth 47. In the proximity of its top end, the duct 42 is provided with an O-ring 41 that extends over the entire periphery of the duct 42, and that is for coming into leaktight sliding contact with the plunger 5, as described below. At its bottom end, the duct 42 is extended by a high abutment seat 44 that also defines the inlet to the chamber 43. In this embodiment, the chamber 43 presents a diameter that is greater than the diameter of the duct 42, such that the high abutment seat 44 flares outwards from the bottom end of the duct 42. At its bottom end, the chamber 43 narrows at a low abutment seat 45. Just like the high abutment seat 44, the seat 45 presents a frustoconical shape that flares, this time inwards, contrary to the seat 44. Just below the low abutment seat 45, the sleeve 4 is provided with annular sealing means 46 that, in this embodiment, are in the form of an O-ring that is advantageously flat. The diameter of the O-ring is adapted in such a manner as to be suitable for coming into sealed contact against the projecting collar 33 formed by the pouch support 3. The sealing and injection mouth 47 extends below the flat O-ring 46 and advantageously presents a beveled peripheral wall so as to make it easier to insert the reservoir, and more particularly the collar 33, into the mouth 47, until coming into leaktight engagement against the O-ring 46.

In addition, the sleeve 4 is provided with a lateral vacuum connector 48 that passes through the wall thickness of the sleeve 4 in such a manner as to put the duct 42 directly into communication laterally with the outside. The vacuum connector 48 is for connecting by means of a tube to a vacuum source (not shown) that can be a vacuum pump.

Figure 3:
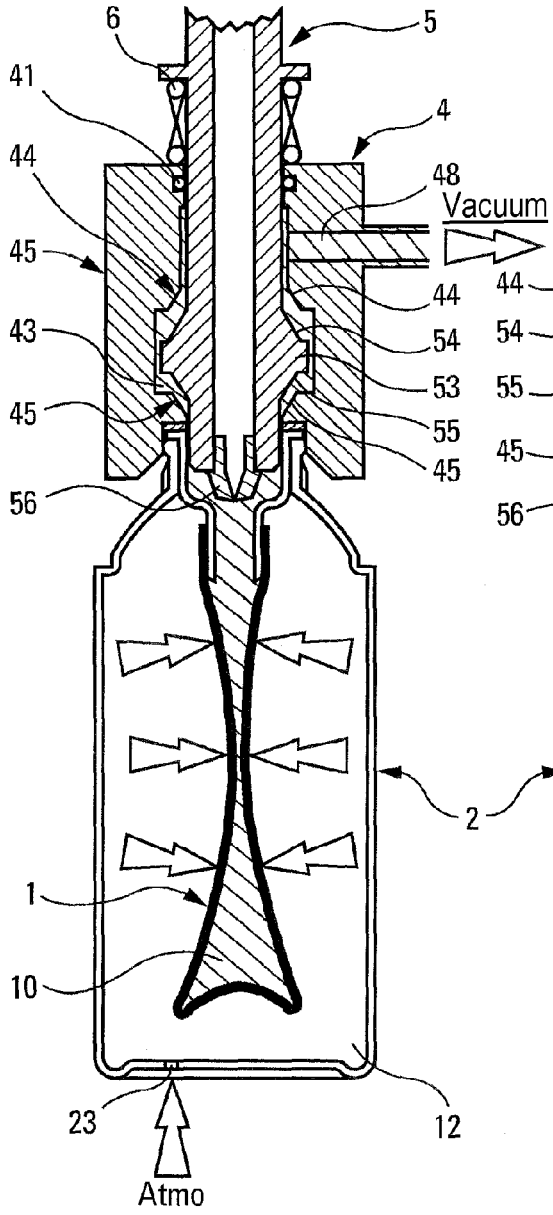

The injection plunger 5 is in the form of a rod 51 that presents a hollow inside 50 that defines a passage for the fluid. The top end of the plunger is for connecting, by means of an appropriate tube, to a fluid source. The plunger 5 includes a peripheral flange 52 that projects radially outwards. The flange 52 serves as a bearing surface for the return spring 6 that is engaged around the plunger 5 and that also bears against the top of the sleeve 4. As a result, the plunger 5 also serves as guide means for the helical spring 6 that extends around the plunger. Thus, it should be understood that the plunger 5 is urged upwards by the return spring 6 relative to the sleeve 4. Beyond the spring 6, the plunger 5 extends through the sleeve 4, and more precisely through the duct 42 and the chamber 43, as far as the sealing and injection mouth 47. The plunger 5 thus extends through the duct 42 in such a manner as to be capable of sliding inside the duct 42 without sealing except at the O-ring 41 that comes into leaktight sliding contact with the plunger 5. Except at the O-ring 41, the plunger 5 is not in leaktight contact with the duct 42. A substantially-cylindrical annular gap is thus formed between the duct 42 and the plunger 5, which gap can communicate directly with the vacuum connector 48. The plunger 5 preferably forms a substantially-cylindrical section at the duct 42 which is itself substantially cylindrical. Below the cylindrical section, the plunger 5 forms a substantially-annular peripheral bead 53 that projects radially outwards relative to the cylindrical section engaged inside the duct 42. On either side, the bead 53 defines a substantially-frustoconical annular ring, namely a top ring 54 and a bottom ring 55. The top ring 54 flares downwards, whereas the bottom ring 55 flares upwards. The projecting bead 53 is housed inside the chamber 43 formed by the sleeve 4. The top ring 54 is for coming into leaktight contact with the high abutment seat 44 formed by the sleeve 4. In symmetrical manner, the bottom ring 55 is for coming into leaktight contact with the low abutment seat 45 formed by the sleeve 4. The bead 53 is held captive by the sleeve 4 inside its chamber 43. It is therefore not possible to remove the plunger from the inside of the sleeve 4 as a result of the bead 53 being held captive by the chamber 43. In contrast, it is possible to displace the plunger 5 axially inside the sleeve 4 against the action exerted by the return spring 6, between the two abutment seats 44 and 45. In the rest position shown in FIG. 1, the top ring 54 is in leaktight contact with the high abutment seat 44. In contrast, in FIGS. 4 and 5, the bottom ring 55 is in leaktight contact with the low abutment seat 45. Between these two leaktight contacts, as shown in FIG. 3, the plunger 5 and the sleeve 4 are not in leaktight contact, except via the O-ring 41. Below the bottom ring 55, the plunger 5 is extended by a section of smaller diameter than the bead 53. Advantageously, the diameter of this bottom section is substantially equal to the diameter of the section engaged inside the duct 42. At its bottom end, the plunger 5 forms a fluid outlet that is advantageously provided with a leaktight shutter 56 that is closed in the rest position, and that also prevents anything from entering into the plunger 5 through the shutter 56.

Reference is made below to the various FIGS. 1 to 6 in succession in order to explain in detail a complete operating cycle of the filling device of the invention.

Figure 2:
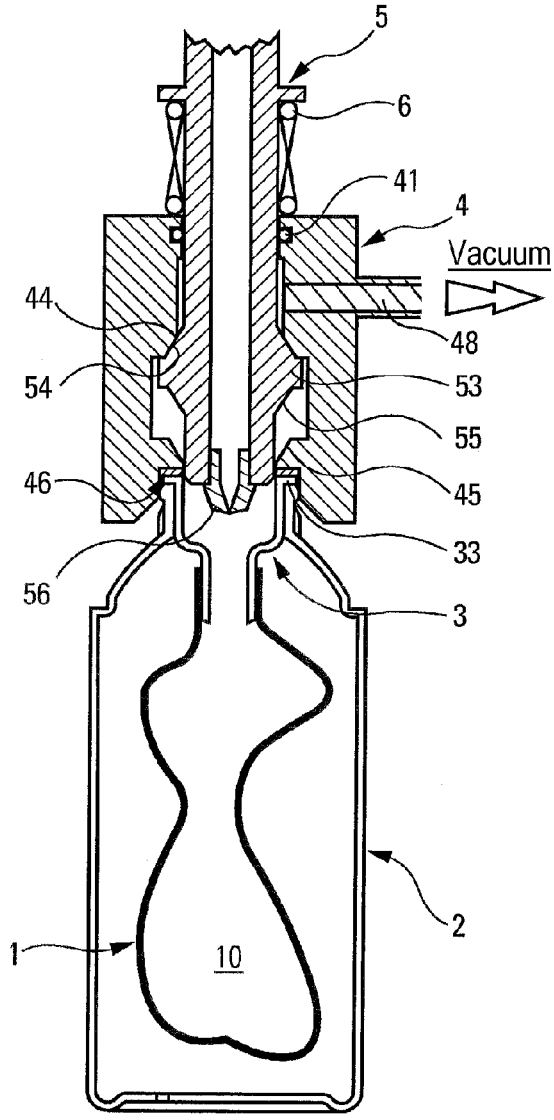
Figure 4:
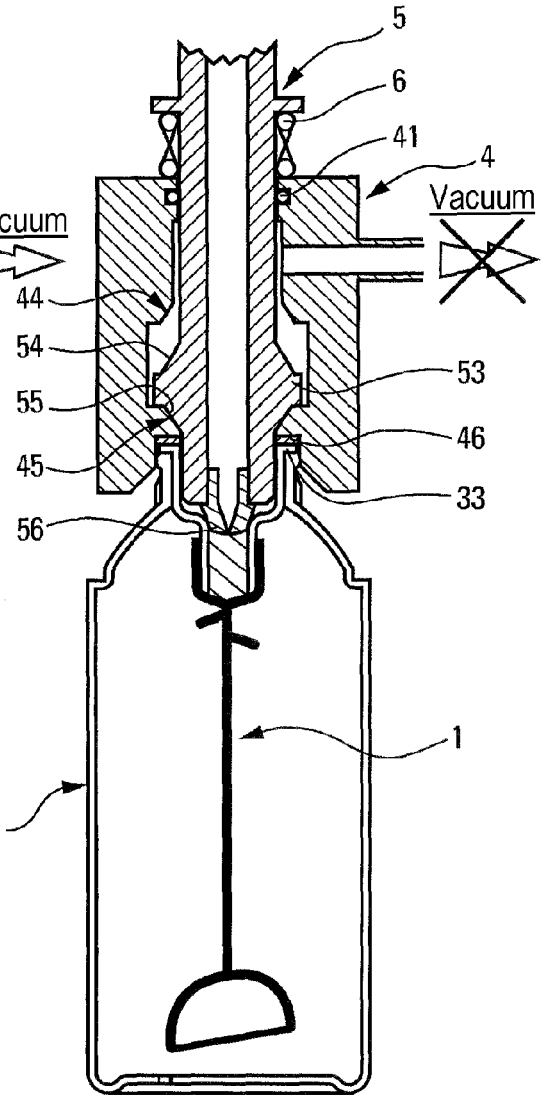
Figure 5:
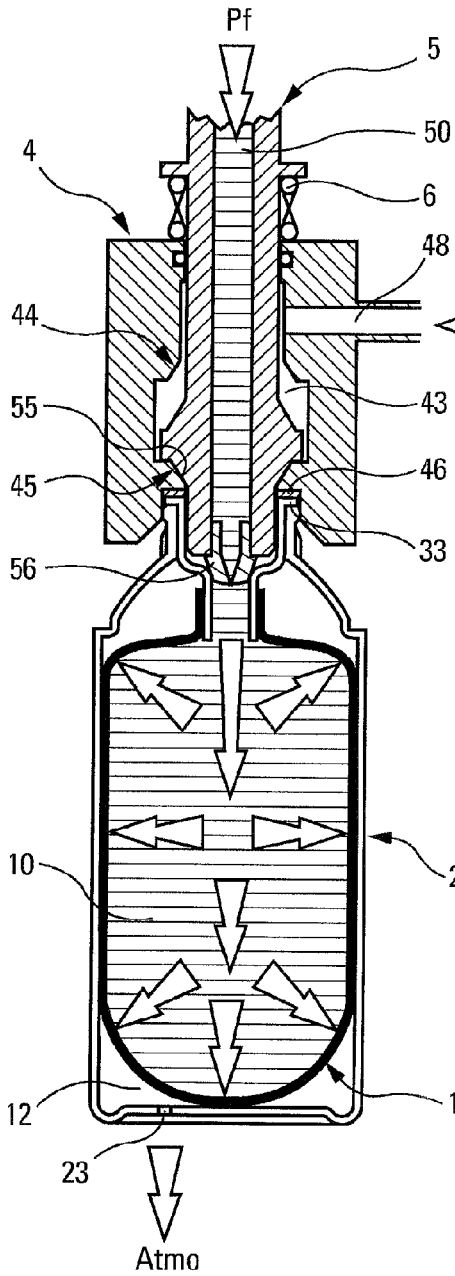
Figure 6:
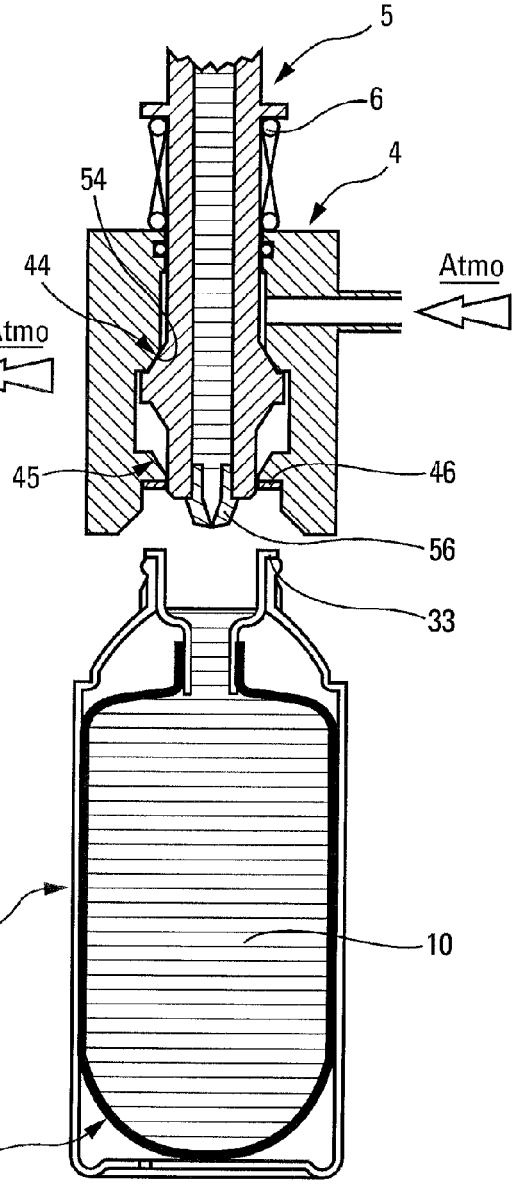

With reference firstly to FIG. 1, it is possible to see the evacuating/filling head of the filling device of the invention in the standby position. Before initiating any displacement of the evacuating/filling head, it is firstly necessary to ensure that the packaging or receptacle is properly positioned just below the head. It is necessary for the opening 21 of the reservoir to be situated axially just below the plunger 5. In general, the evacuating/filling head is held and displaced by the plunger 5. It is not necessary to hold the sleeve 4 in order to displace it. In the standby position, that ideally corresponds to the rest position of the head, the top ring 54 is in leaktight contact with the high abutment seat 44. Thus, the vacuum connector 48 cannot communicate with the outside via the duct 42, given that it is sealed in the proximity of its top end by the O-ring 41, and at its bottom end by the ring 54 in contact with the seat 44. Once the head is correctly positioned above the opening 21, the head can begin to be lowered onto the reservoir until the head comes into engagement with the reservoir, as can be seen in FIG. 2. The head, or more precisely the flat O-ring 46 that is situated in the sealing and injection mouth 47, comes into leaktight contact with the collar 33 that is formed by the pouch support 3. The neck 22 of the shell 2 is thus engaged inside the mouth 47. Its insertion is made easier by the presence of the inlet bevel of the mouth 47. When the O-ring 46 comes into contact with the collar 33, leaktight contact is also established between the ring 54 and the seat 44. In contrast, when greater pressure is exerted on the plunger 5, the sleeve 4 bears against the collar 33 even more, until the return spring 6 begins to contract. Just before or just after the spring 6 begins to contract, it is possible to activate the vacuum source that is connected to the vacuum connector 48. This is indicated by the arrow labeled VACUUM in FIG. 2. The vacuum state is represented in FIG. 2 by widely-spaced sloping hatching lines. The vacuum state extends as far as the annular gap that is formed between the duct 42 and the plunger 5. However, the vacuum does not extend into the chamber 43, as a result of the ring 54 being in leaktight contact with the seat 44. By continuing to press on the plunger 5, that contact ceases to exist, as shown in FIG. 3. From then on, the vacuum state that was in the vacuum connector 48 propagates into the chamber 43 and on into the reservoir 1. This is shown in FIG. 3 by the sloped hatching visible inside the reservoir 1. Naturally, this vacuum state decreases the working volume of the reservoir 1 shown by the six arrows inside the shell 2. Simultaneously, air penetrates into the intermediate space 12 through the vent orifice 23. This is shown by the arrow labeled ATMO. It is thus possible to continue evacuating the air from inside the reservoir until it reaches the configuration shown in FIG. 4. In this configuration, the working volume of the reservoir is zero or substantially zero. In any event, there is no longer any air inside the reservoir. It is possible to continue to apply an ever-increasing force on the plunger 5 until the bottom ring 55 comes into leaktight contact with the low abutment seat 45 (FIG. 4). From then on, the vacuum state exerted by the vacuum pump (not shown) no longer has an evacuation path through the sleeve. The vacuum pump can now be switched off. This is indicated by the crossed-out arrow labeled VACUUM in FIG. 4. While maintaining the reservoir with its working volume at zero, i.e. by maintaining the sealing between the O-ring 46 and the collar 33, fluid can start to be injected through the plunger 5 in such a manner as to fill the reservoir 1. This is indicated by the horizontal hatching in FIG. 5. The working volume of the reservoir increases, as shown by the arrows inside the reservoir. Simultaneously, the air present in the intermediate space 12 is evacuated through the vent orifice 23. While the fluid is being injected, the shutter 56 is naturally urged into its open position. Given that evacuation has been interrupted, the chamber 43 is at atmospheric pressure. This is indicated by the arrow labeled ATMO in FIG. 5. Given that the pouch was initially completely evacuated before injection, it is guaranteed to be filled completely and totally with fluid, to the exclusion of any air bubbles. Finally, the reservoir is as shown in FIG. 6. The head can now be raised, i.e. the pressure exerted on the plunger 5 can be interrupted, such that the return spring 6 once again urges the plunger 5 into its rest position, i.e. with its top ring 54 in engagement with its seat 44. The same position as the position shown in FIG. 1 is thus reached.

Although not shown, a subsequent step is performed of mounting a pump or a valve on the reservoir in leaktight manner. This mounting step can optionally be performed under a vacuum.

By means of the invention, it is no longer necessary to operate the vacuum pump during the injection step of injecting fluid into the reservoir. In the present invention, while the fluid is being injected into the reservoir, evacuation has already ceased. However, the completely evacuated state of the reservoir is maintained.

The invention claimed is:

1. A filling method for filling a reservoir of variable working volume with a fluid, the method comprising:

an evacuation step in which the reservoir is firstly emptied of any content, such that a working volume of the reservoir is zero or substantially zero; and an injection step in which the fluid is then injected into the reservoir, thereby increasing the working volume of the reservoir; and a mounting step following the injection step in which a pump is mounted on the reservoir in leaktight manner;

wherein the injection of the fluid into the reservoir starts while the working volume of the reservoir is zero or substantially zero; and wherein the reservoir is a flexible pouch disposed inside an outer shell defining a space there between and the space is maintained at atmospheric pressure throughout the filling method.

2. A filling method according to claim 1, in which the evacuation step and the subsequent injection step are performed while an opening of the reservoir is being maintained leaktight.

3. The filling method according to claim 1, wherein the zero or substantially zero volume is maintained until the injection step.

* * * * *